US008226184B2

(12) United States Patent
Kang et al.

(10) Patent No.: US 8,226,184 B2
(45) **Date of Patent: *Jul. 24, 2012**

(54) HEIGHT ADJUSTING APPARATUS OF SHELF FOR REFRIGERATOR

(75) Inventors: Byeong-Gyu Kang, Gyeongsangnam-Do (KR); Jae-Youl Lee, Gyeongsangnam-Do (KR); Ki-Hoon Song, Gyeongsangnam-Do (KR); Jeong-Ho Shin, Gyeongsangnam-Do (KR); Jong-Seok Yoon, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 141 days.

This patent is subject to a terminal disclaimer.

(21) Appl. No.: 12/515,508

(22) PCT Filed: Nov. 20, 2007

(86) PCT No.: PCT/KR2007/005835

§ 371 (c)(1),
(2), (4) Date: May 19, 2009

(87) PCT Pub. No.: WO2008/062991

PCT Pub. Date: May 29, 2008

(65) Prior Publication Data

US 2010/0060125 A1 Mar. 11, 2010

(30) Foreign Application Priority Data

Nov. 20, 2006 (KR) ..... 10-2006-0114401
Nov. 20, 2006 (KR) ..... 10-2006-0114406

(51) Int. Cl.
*A47B 96/04* (2006.01)
*A47B 95/02* (2006.01)
*A47B 57/00* (2006.01)
*A47B 9/00* (2006.01)

(52) U.S. Cl. ..... 312/408; 312/319.1; 312/306; 108/108; 108/147.11

(58) Field of Classification Search ..... 312/408, 312/404, 306, 12, 319.1, 351, 312; 108/108, 108/147.11–147.14; 292/103, 204
See application file for complete search history.

(56) References Cited

U.S. PATENT DOCUMENTS 464,918 A 12/1891 Bacon
(Continued)

FOREIGN PATENT DOCUMENTS

CN 2248266 Y 2/1997
(Continued)

OTHER PUBLICATIONS

European Patent Office, Machine Translation: "Description of FR-2850002", pp. 1-2. Retrieved on Feb. 25, 2011. http://translationgateway.epo.org/.*

*Primary Examiner* — Darnell Jayne
*Assistant Examiner* — Kimberley S Wright
(74) *Attorney, Agent, or Firm* — Birch, Stewart, Kolasch & Birch, LLP

(57) ABSTRACT

A height adjusting apparatus of a shelf for a refrigerator in a refrigerator having the shelf on which objects to be stored are placed and which is movable up or down to a certain height, the apparatus comprising: fixing guides formed in parallel with the movement path of the shelf; and operation levers movable along the fixing guides when the shelf is moved upwardly or downwardly, and restricted in the fixing guides to maintain the shelf at a height that the shelf is moved upwardly or downwardly when the shelf is completely moved upwardly or downwardly.

6 Claims, 15 Drawing Sheets

U.S. PATENT DOCUMENTS 766,605 A 8/1904 Dilg
984,857 A * 2/1911 Schuftan ..... 108/106
2,002,339 A * 5/1935 Copeman ..... 62/381
2,051,969 A 8/1936 Shastock
2,784,603 A 3/1957 Collins
3,054,511 A * 9/1962 Erismann ..... 211/208
3,128,074 A * 4/1964 Schwarz ..... 248/246
3,316,044 A 4/1967 Carbary
3,337,283 A 8/1967 Schlenkert
3,356,328 A * 12/1967 Sachau ..... 248/245
3,437,060 A * 4/1969 Giambalvo ..... 108/151
3,601,432 A 8/1971 Fenwick et al.
3,726,581 A 4/1973 Doepke
3,730,108 A 5/1973 Stroh
3,730,468 A * 5/1973 Magnusen ..... 248/246
3,848,844 A 11/1974 Barrett
3,885,846 A 5/1975 Chuang et al.
3,964,404 A 6/1976 Mueller et al.
4,056,196 A * 11/1977 Brauning ..... 211/207
4,138,175 A * 2/1979 Tattershall ..... 312/408
4,156,515 A 5/1979 Mochly
4,614,273 A * 9/1986 Ishii ..... 211/183
4,901,965 A 2/1990 Bowman
5,151,072 A * 9/1992 Cone et al. ..... 482/104
5,199,579 A * 4/1993 Van Duyne ..... 211/90.04
5,199,778 A * 4/1993 Aoki et al. ..... 312/408
5,338,137 A 8/1994 Jensen
5,381,738 A 1/1995 Meyer
5,415,302 A * 5/1995 Carlson et al. ..... 211/187
5,483,902 A * 1/1996 Grosch ..... 108/143
5,531,167 A * 7/1996 Stevens et al. ..... 108/106
5,644,993 A 7/1997 Dohnalik
5,687,655 A 11/1997 Weinschenk, Jr. et al.
5,695,078 A * 12/1997 Otema ..... 211/103
5,799,588 A * 9/1998 Engel ..... 108/108
5,913,584 A * 6/1999 Swindell et al. ..... 312/408
6,017,009 A 1/2000 Swartz et al.
6,065,821 A * 5/2000 Anderson et al. ..... 312/408
6,105,794 A 8/2000 Bauer
6,113,042 A * 9/2000 Welsch et al. ..... 248/218.4
6,811,045 B1 11/2004 Masker et al.
7,455,629 B2 * 11/2008 Abelbeck ..... 482/92
8,152,258 B2 * 4/2012 Kang et al. ..... 312/408
2006/0013676 A1 1/2006 Oh et al.
2006/0252609 A1 * 11/2006 Abelbeck ..... 482/92
2008/0067909 A1 * 3/2008 Hanson et al. ..... 312/408
2008/0314850 A1 * 12/2008 Haarmann ..... 211/90.02
2009/0115302 A1 * 5/2009 Benz et al. ..... 312/408
2010/0064721 A1 * 3/2010 Shin et al. ..... 62/465

FOREIGN PATENT DOCUMENTS

FR 2850002 A1 7/2004
GB 233422 A * 5/1925
KR 10-1997-0011759 A 3/1997
KR 20-1997-0014663 A 4/1997
KR 20-1999-0009504 A 3/1999
WO WO 91/13314 A1 9/1991

* cited by examiner

[Fig. 1]
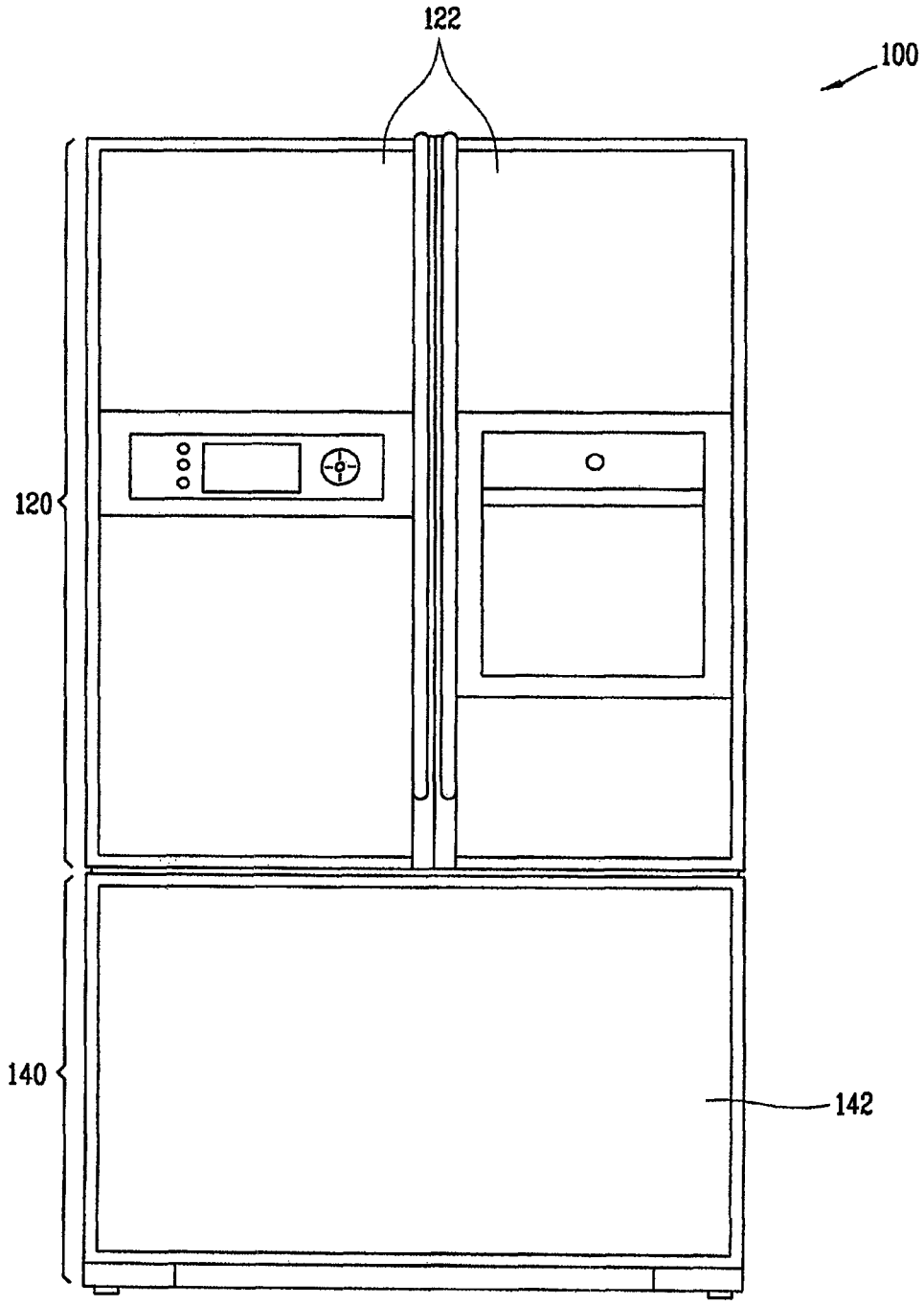

[Fig. 2]
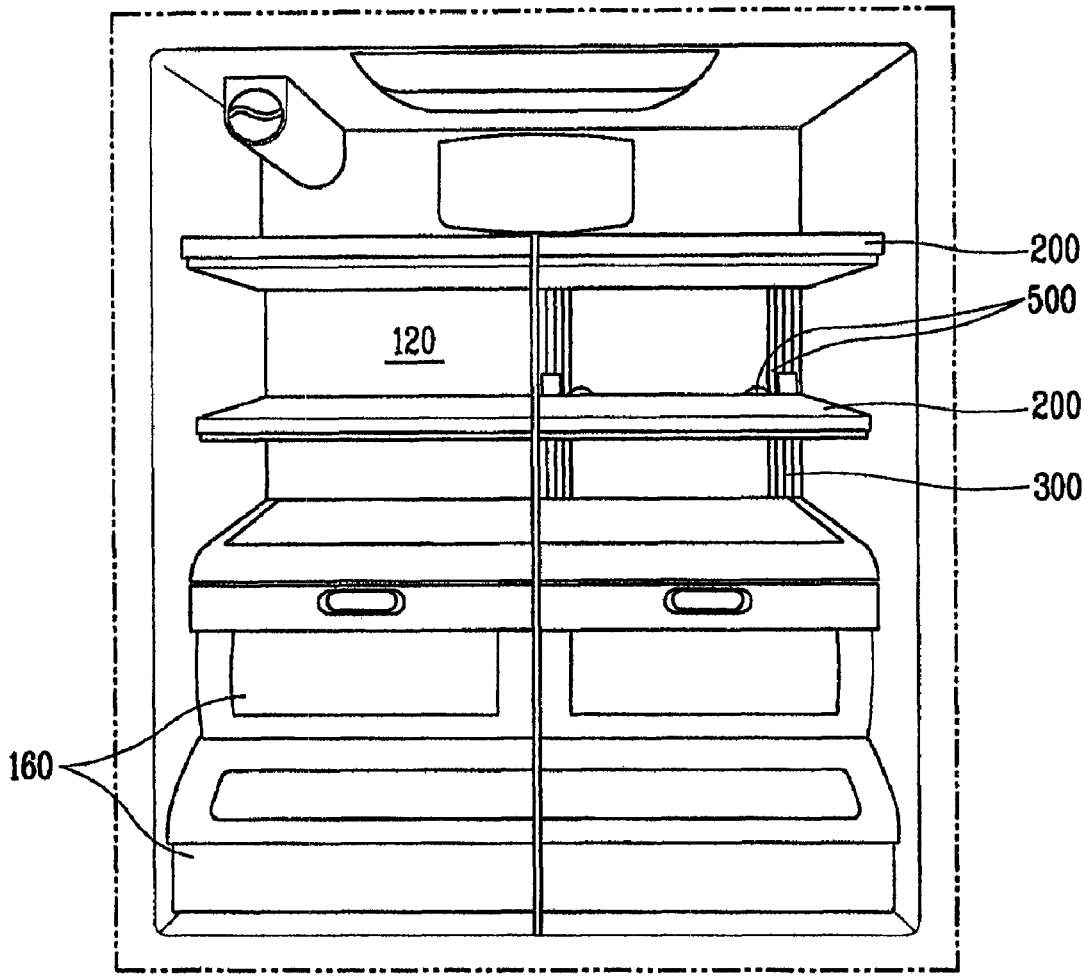

[Fig. 3]
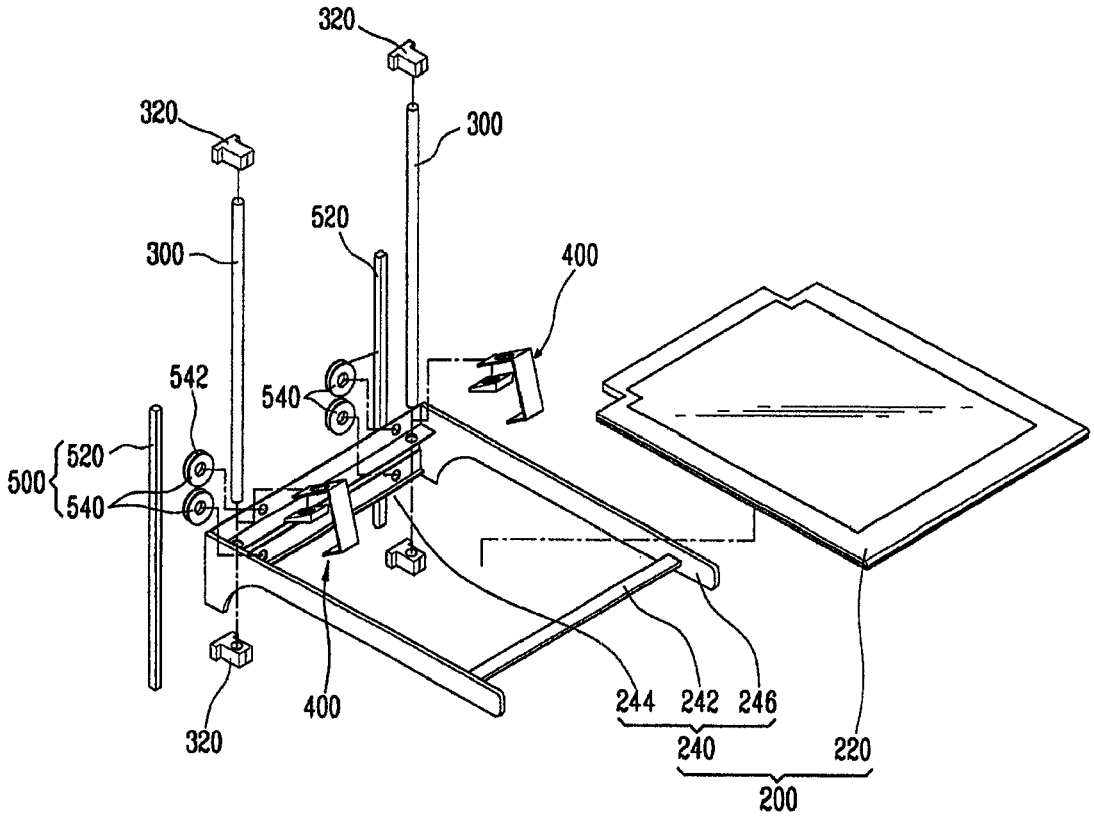

[Fig. 4]
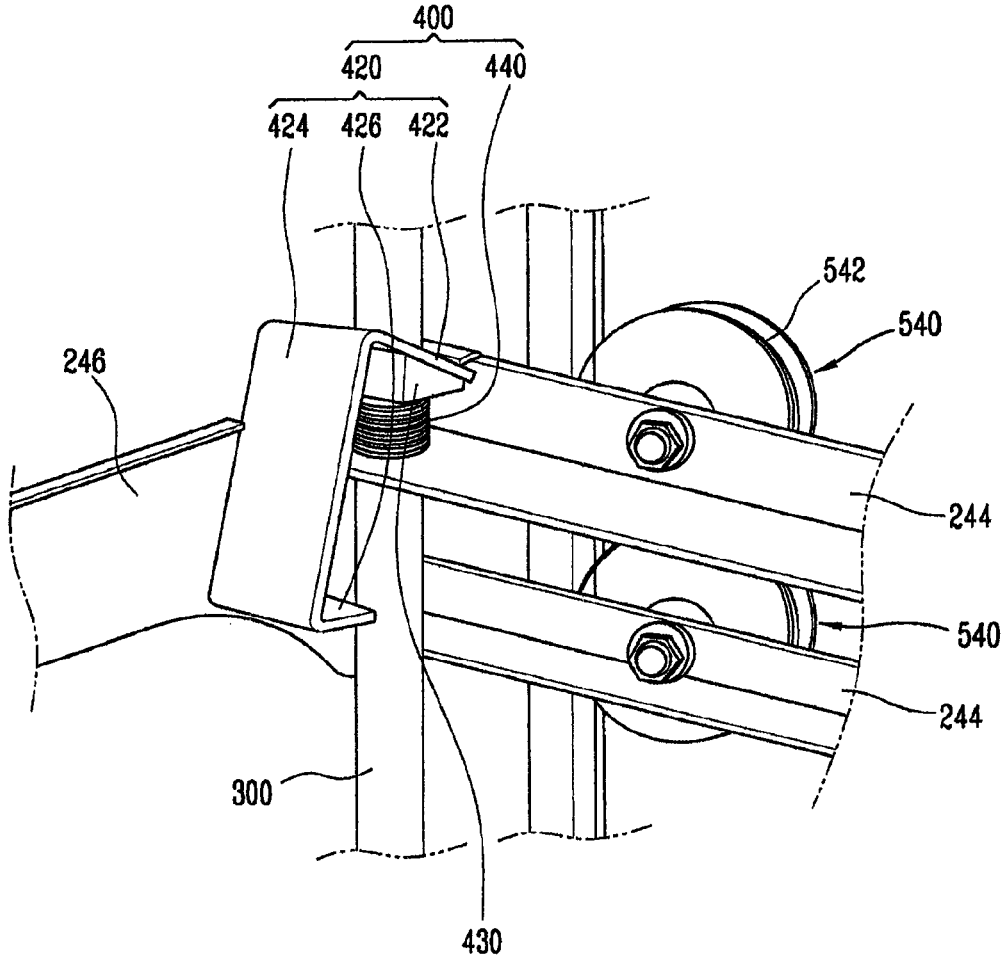

[Fig. 5]
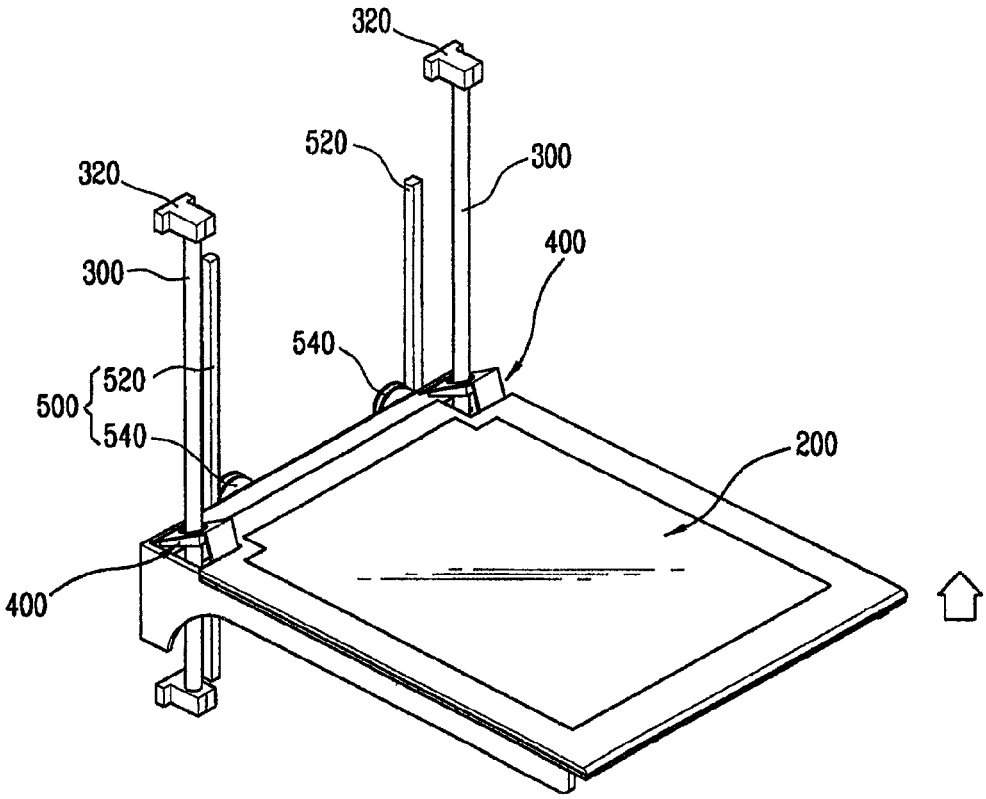

[Fig. 6]
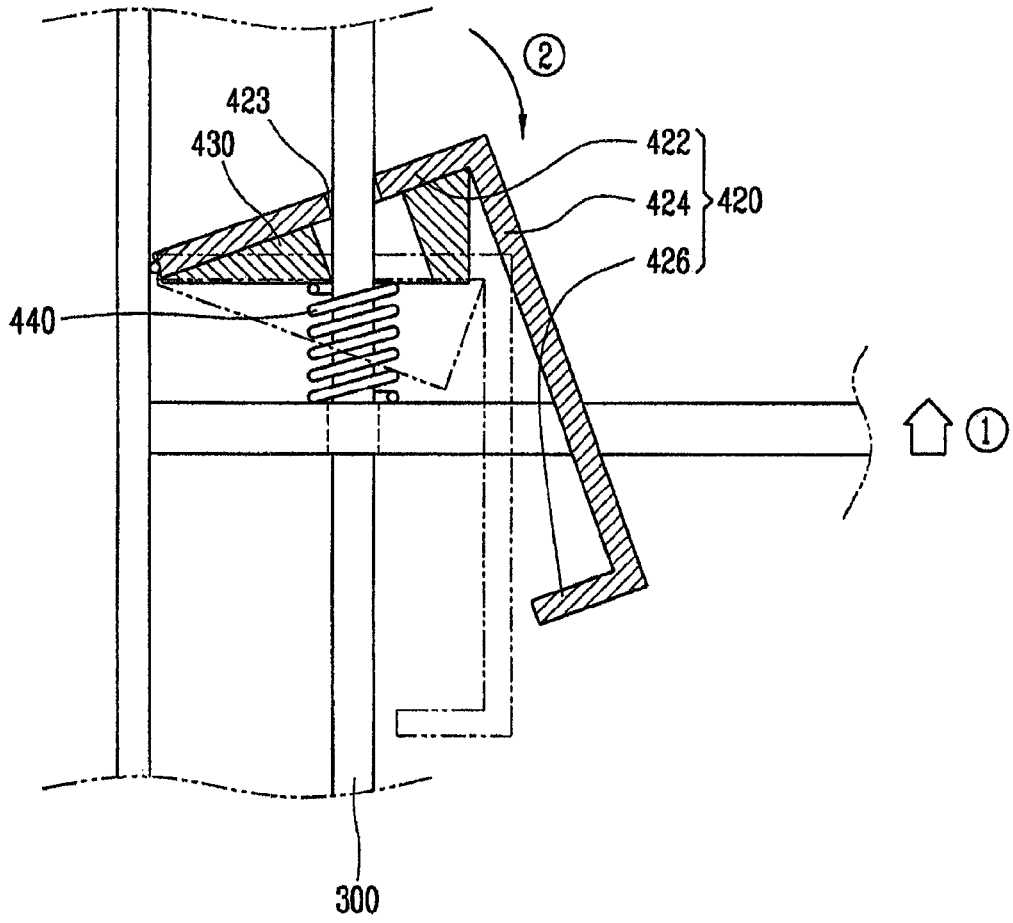

[Fig. 7]
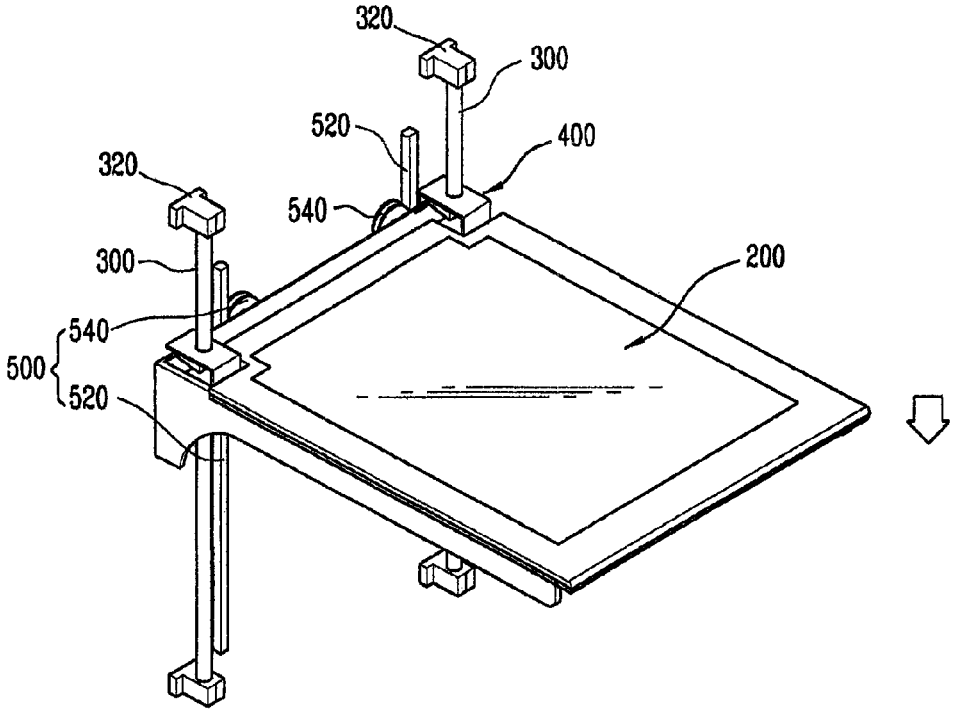
[Fig. 8]
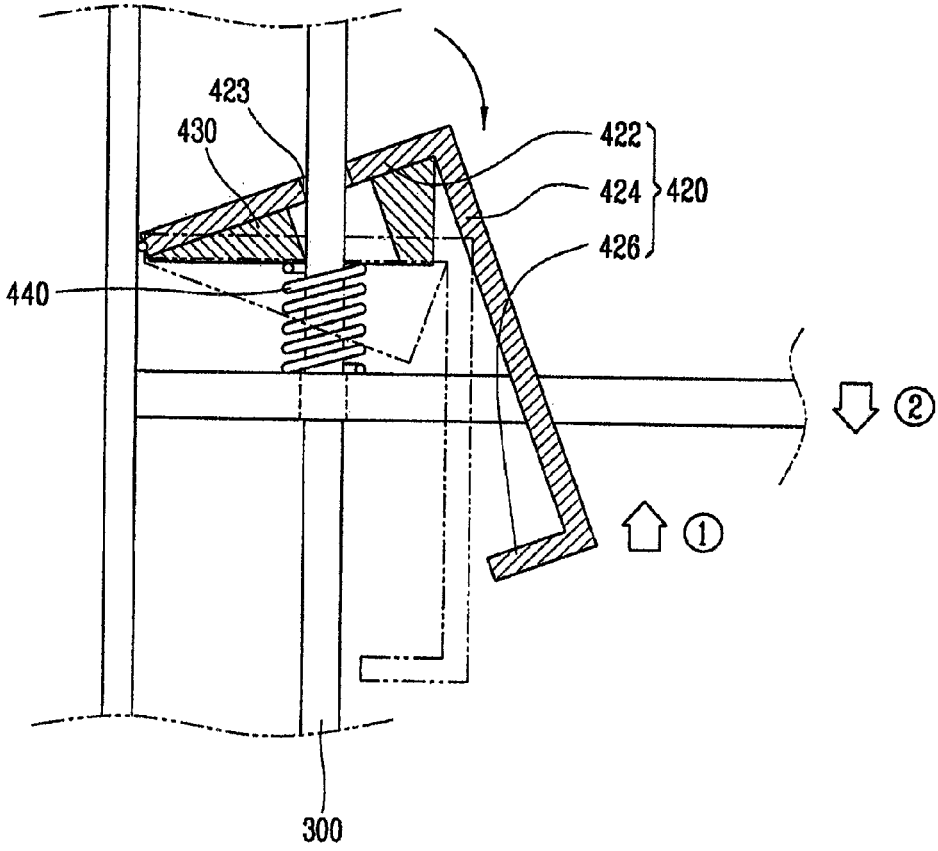

[Fig. 9]
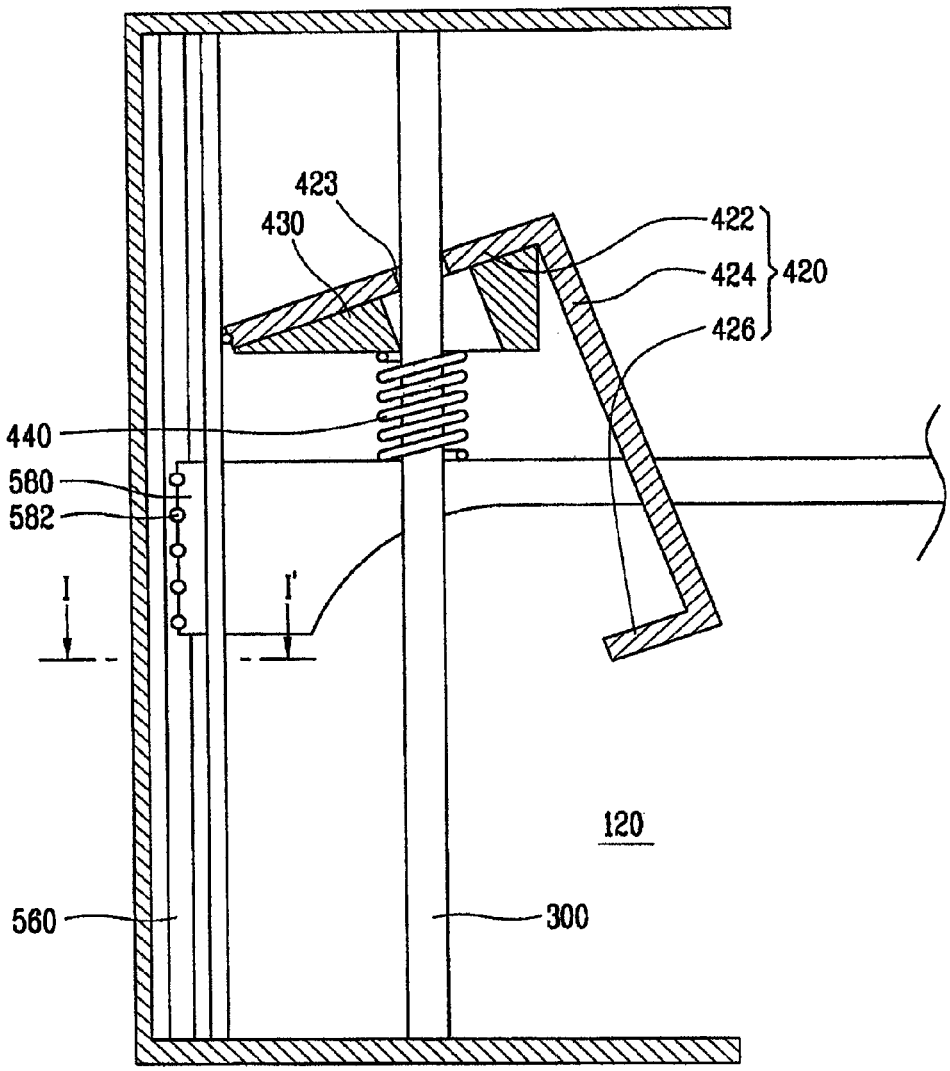

[Fig. 10]
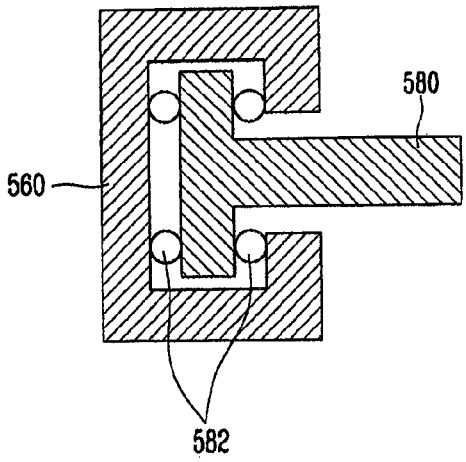
[Fig. 11]
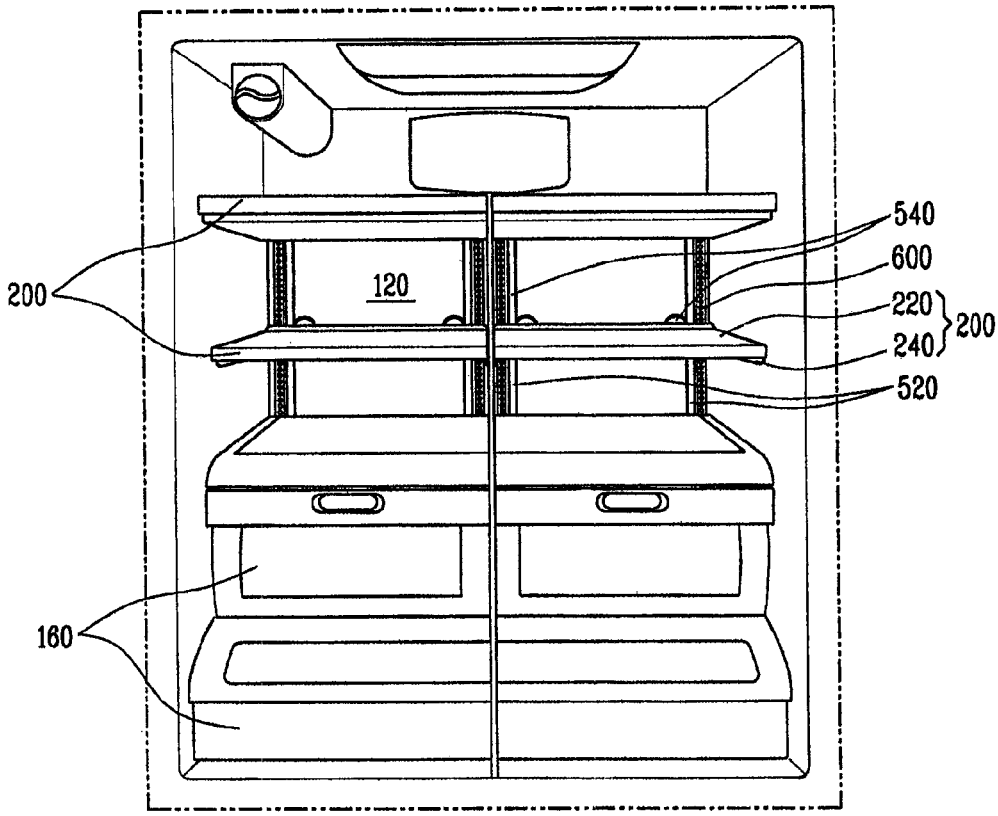

[Fig. 12]
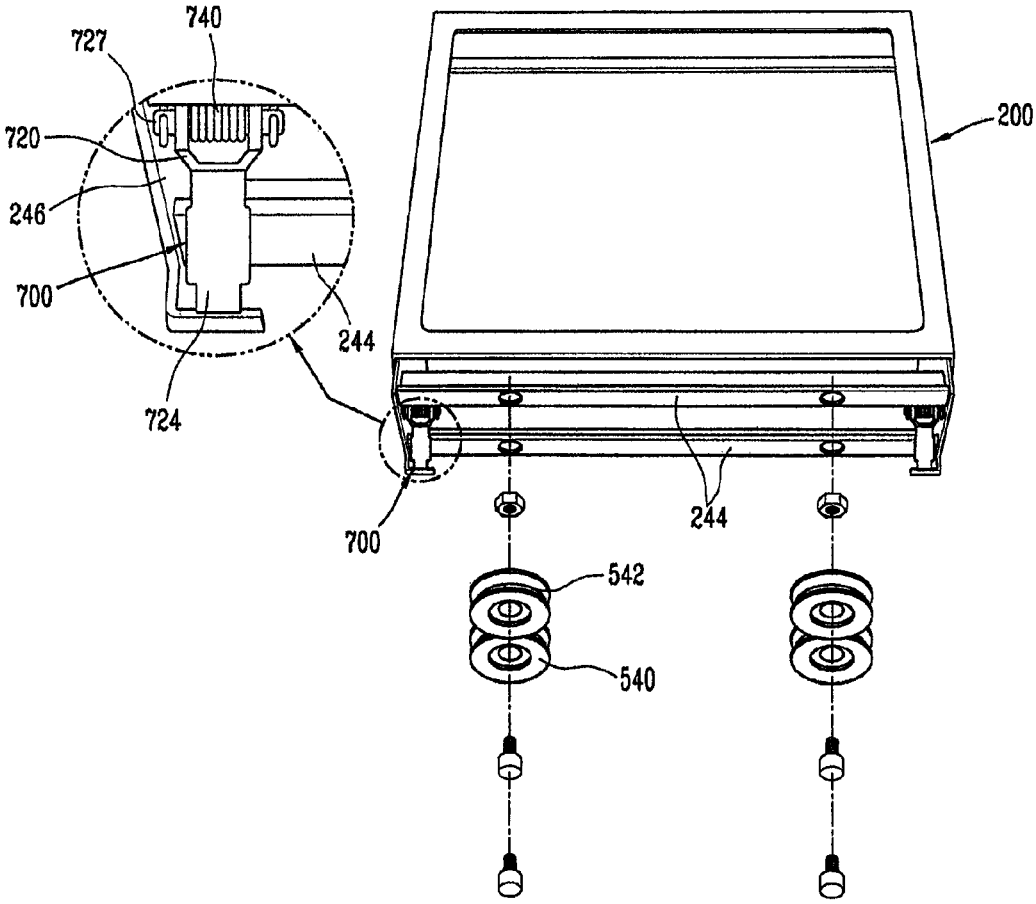

[Fig. 13]
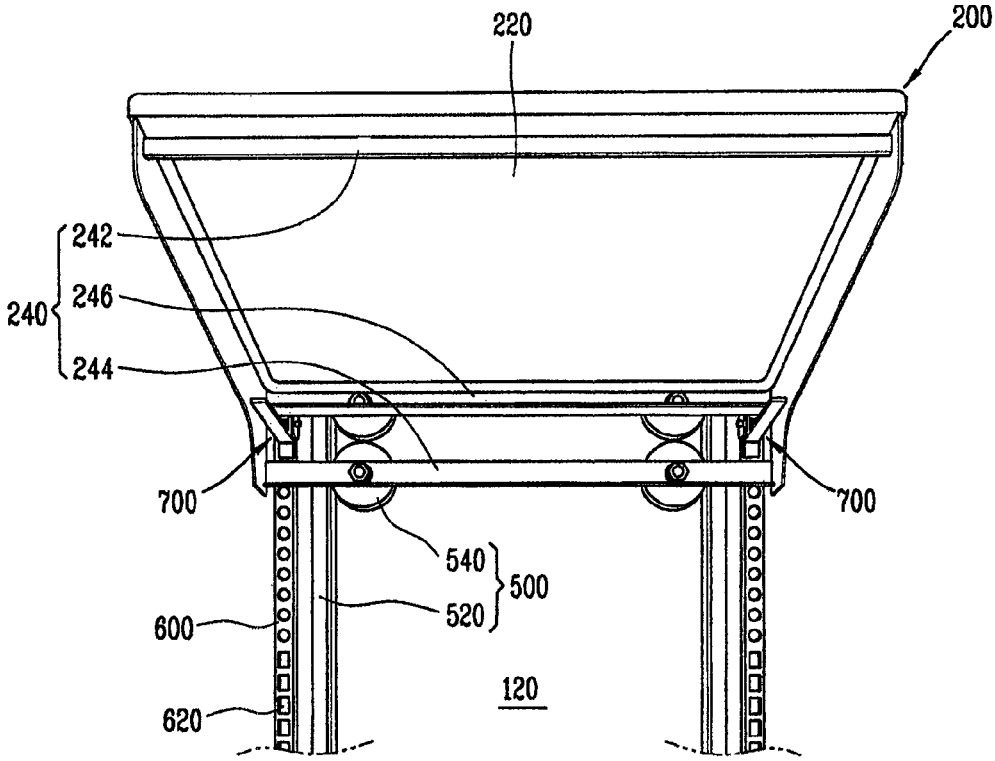

[Fig. 14]
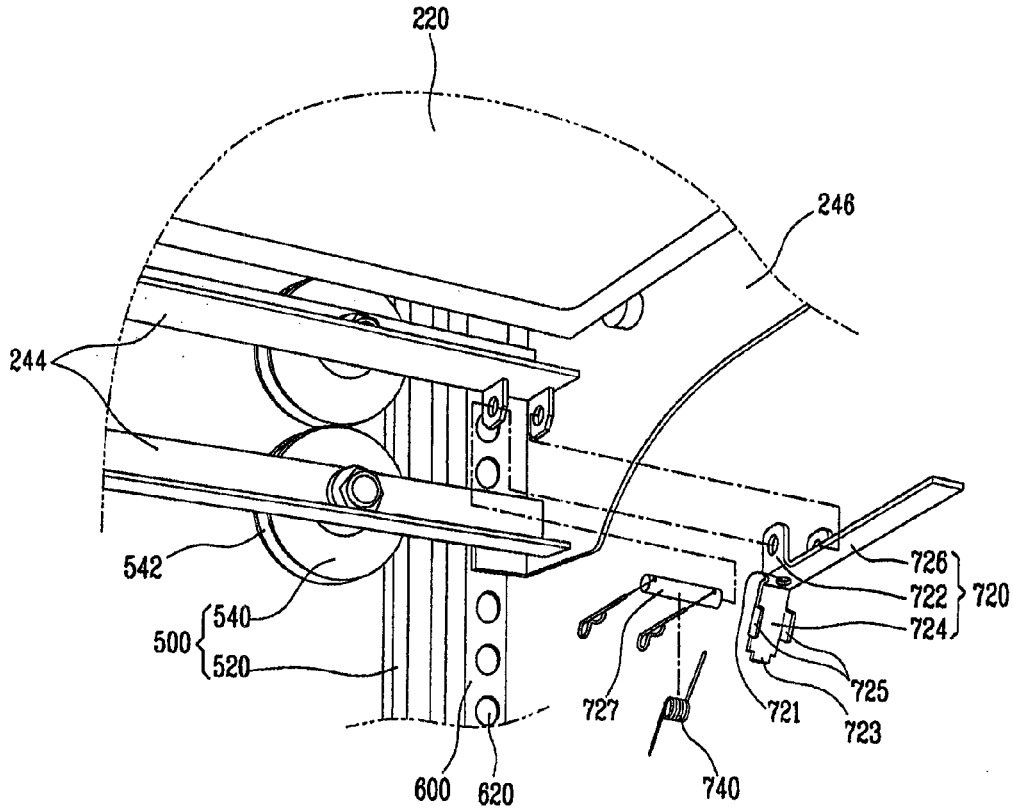
[Fig. 15]
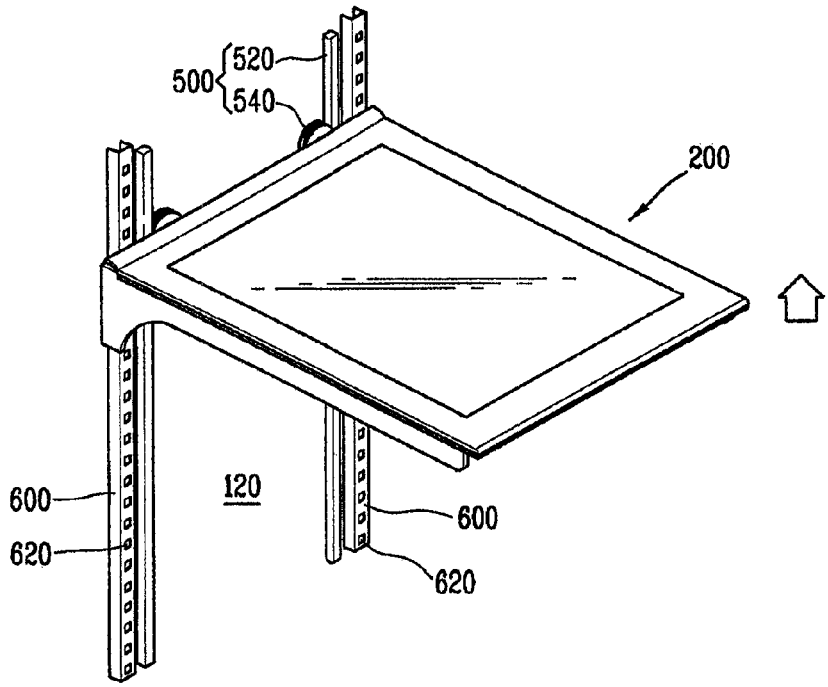

[Fig. 16]
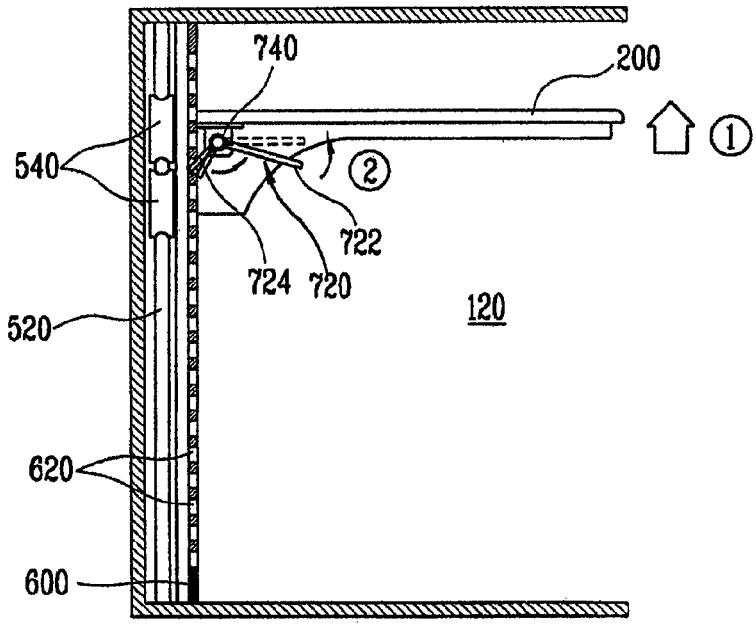
[Fig. 17]
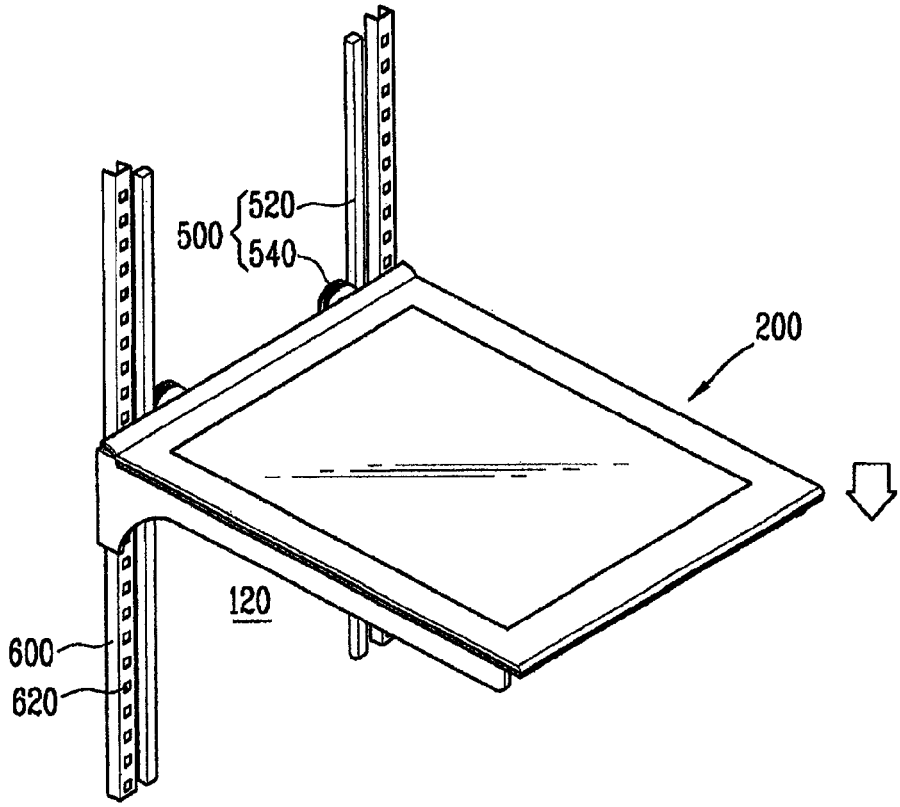

[Fig. 18]
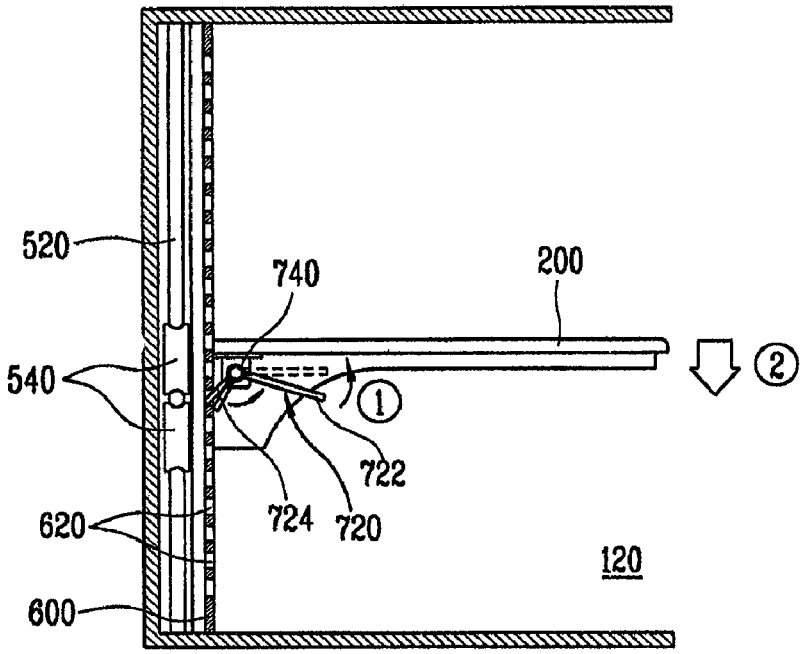
[Fig. 19]
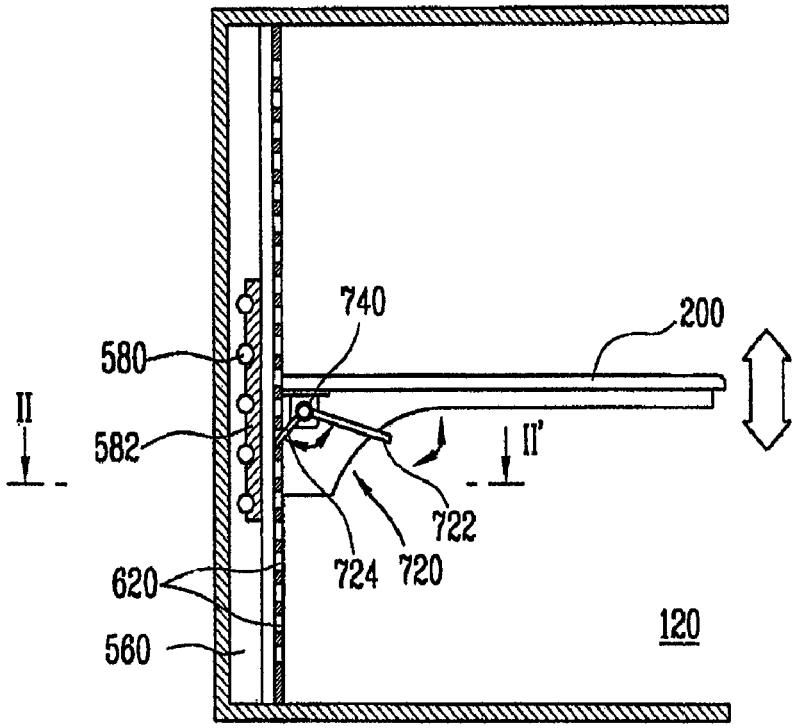

[Fig. 20]
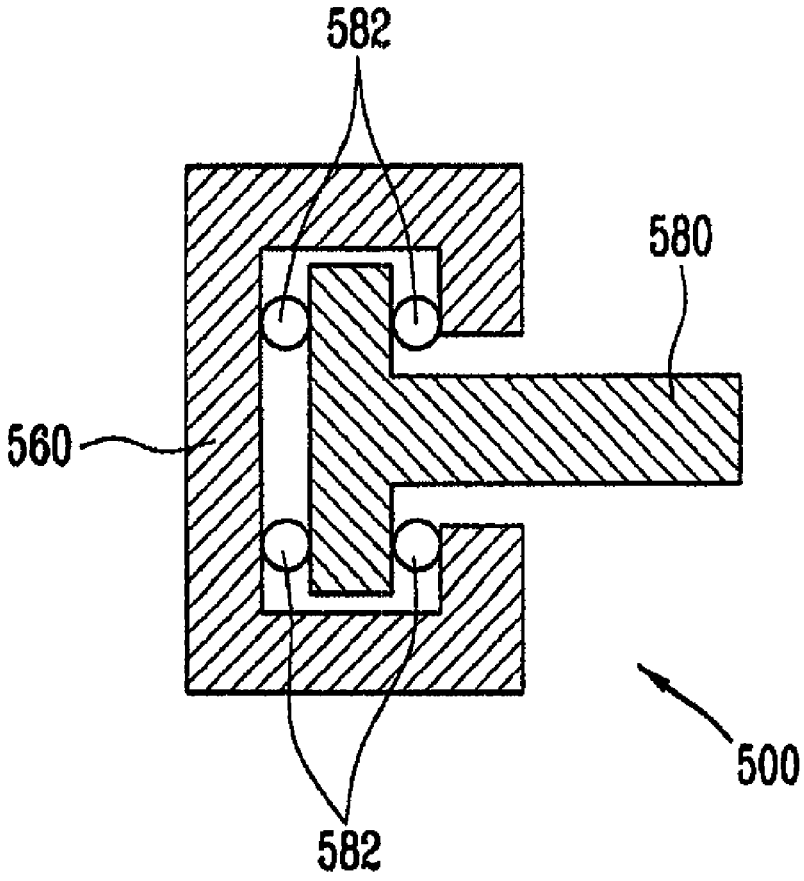

HEIGHT ADJUSTING APPARATUS OF SHELF FOR REFRIGERATOR

TECHNICAL FIELD

The present invention relates to a refrigerator, and more particularly, to a height adjusting apparatus of a shelf for a refrigerator.

BACKGROUND ART

In general, a refrigerator, which is to store food at a low temperature, keeps food in a freezing chamber and a refrigerating chamber according to the state of food to be stored.

Cold air supplied into the refrigerator may be generated by a heat-exchange of a refrigerant, and continuously supplied into the refrigerator by a repetition of cycle of compression-condensation-expansion-evaporation. The supplied refrigerant is uniformly delivered into the refrigerator by convection current such that food in the refrigerator can be stored at a desired temperature.

As users' life styles are changed and users' demands are increasing, the refrigerator is getting large in size and multi-functional. Also, various shapes of the refrigerator are provided according to the construction of a storage space.

Various foods which should be stored in a freezing chamber or a refrigerating chamber may properly be stored in shelves, drawers, baskets or the like provided in the refrigerator. Such shelf, drawer, basket or the like may partition the storage space of the refrigerator such that various food having different sizes and storage conditions can be stored at a low temperature.

The shelves partitioning the storage space in the refrigerator may be disposed at different positions so as to allow various constructions of the storage space in the refrigerator. Accordingly, a user can adjust the position where a shelf is disposed to store food having various sizes or containers having food therein to construct appropriate spaces.

As a representative disposed structure of the shelf, molded ends are formed at left and right wall surfaces in the refrigerator such that the shelf can be disposed on the molded ends. However, this structure just allows the shelf to be disposed on positions where the molded ends are formed, which may cause limitations on the mounting of the shelf. In addition, forming many molded ends may increase fabrication cost and decrease attraction of the inner space of the refrigerator.

In the meantime, another structure of the shelf mounted is that a guide having a plurality of holes is installed on a rear wall surface in the refrigerator, such that a shelf having an annular coupling portions is coupled into the holes of the guide, thereby mounting the shelf in a shape like a cantilever.

However, in this structure, the shelf should be completely detached from the guide to be re-attached in order to change the disposed position of the shelf. To this end, articles on the shelf should be taken out of the shelf, and then the shelf should be attached onto a new position to thereafter put the articles removed on the shelf again. Furthermore, whenever the shelf is attached, the shelf should be leveled to be appropriately disposed, which results in user's inconvenience in attaching the shelf.

In order to solve those problems, a shelf structure is disclosed in U.S. Pat. No. 6,065,821 in which a handle or lever mounted at a shelf turns to adjust a longitudinal height of the shelf engaged with the handle or lever by gears.

However, in the related art, the handle or lever should continuously turn to adjust the height of the shelf. Accordingly, if the shelf should be long moved, the handle should also turn for a long time, resulting in user's inconvenience.

In addition, if articles such as food are stored on the shelf, much time and force are required to turn the handle or lever to move the shelf up and down due to the weights of the articles.

Also, gears or sprocket-shaped components perform a relative motion to occur considerable noise. When articles are stored on the shelf, noise becomes worse, which may make the user uncomfortable.

Furthermore, a complicated structure causes difficulty to attach or detach the shelf.

DISCLOSURE OF THE INVENTION

Therefore, it is an object of the present invention to provide a height adjusting apparatus of a shelf for a refrigerator having a height adjustable structure for the shelf.

To achieve these objects, there is provided a height adjusting apparatus of a shelf for a refrigerator, in a refrigerator having a shelf on which objects to be stored are placed and which is movable up or down to a certain height, the apparatus comprising: fixing guides formed in parallel with a movement path of the shelf; and operation levers configured to be movable along the fixing guides when the shelf is moved upwardly or downwardly, and to be restricted in the fixing guides to maintain the moved height or location of the shelf when the shelf is completely moved upwardly or downwardly.

In another aspect of the present invention, a height adjusting apparatus of a shelf for a refrigerator in a refrigerator having the shelf on which objects to be stored are placed and which is movable up or down to a certain height, the apparatus comprising: fixing guides formed in parallel with a movement path of the shelf; and operation levers each having a through hole in which the fixing guide is inserted to be moved when the shelf is moved upwardly or downwardly, and rotated such that the fixing guide is in contact with an inner surface of the through hole to maintain the shelf at the height moved when the shelf is completely moved upwardly or downwardly.

In another aspect of the present invention, a height adjusting apparatus of a shelf for a refrigerator in a refrigerator having the shelf on which objects to be stored are placed and which is movable up or down to a certain height, the apparatus comprising: fixing guides formed in parallel with the movement path of the shelf and each having a fixing hole; and operation levers movable along the fixing guides when the shelf is moved upwardly or downwardly, and rotated such that one end of the operation lever is connected to the fixing hole to maintain the shelf at the height moved when the shelf is moved upwardly or downwardly.

In another aspect of the present invention, a height adjusting apparatus of a shelf for a refrigerator in a refrigerator having the shelf on which objects to be stored are placed and which is movable up or down to a certain height, the apparatus comprising: operation levers rotatably connected to the shelf; fixing guides restricting the operation levers according to the rotation of the operation levers to maintain the shelf at a height that the shelf is moved; and elastic members supplying a rotation force to the operation levers.

In another aspect of the present invention, a height adjusting apparatus of a shelf for a refrigerator in a refrigerator having the shelf on which objects to be stored are placed and which is movable up or down to a certain height, the apparatus comprising: operation levers rotatably connected to the shelf; and fixing guides restricting the operation levers according to the rotation of the operation levers to maintain the shelf at a height that the shelf is moved upwardly or downwardly.

EFFECT OF THE INVENTION

A height adjusting apparatus of a shelf for a refrigerator in accordance with one aspect of the present invention may have the following effects.

First, when the shelf is moved upwardly, operation levers restricted in fixing guides are temporarily released. Accordingly, the shelf can be moved only by holding the shelf up without a separate operation for moving the shelf upwardly. Also, after the shelf is completely moved upwardly, the shelf can automatically be fixed onto a location to which the shelf is moved by a restoring force of elastic members.

In addition, if a grabbing portion of each operation lever is pressed when the shelf is moved downwardly, the operation lever is rotated to be released from the fixing guide, which makes the shelf freely moved. The shelf can accordingly be automatically lowered by its own weight and weights of articles (e.g., food, container, etc.) on the shelf. Also, when a hand pressing the grabbing portion is taken off at a desired location, the shelf can be fixed onto that location.

Therefore, a user can adjust the height of the shelf by a simple manipulation without separate operations, such as attaching or detaching the shelf or continuously rotating a height adjusting member when adjusting the height of the shelf, thereby improving user's convenience.

In addition, the shelf has a structure of being fixed by the contact between the operation lever and the fixing guide. Accordingly, since the shelf can be moved to a desired location at once regardless of a distance to be moved, a user can fast adjust the height of the shelf without applying a great force, so as to enhance the user's convenience.

Second, since the height of the shelf can be adjusted by a simple manipulation without detaching the shelf, it can be done without taking articles away from the shelf, thereby maximizing the user's convenience.

Third, in case where any part is not in contact with a fixing unit when the shelf is moved upwardly or downwardly, rolling units are rolled to guide the movement of the shelf. Also, noise which occurs when the shelf is moved upwardly or downwardly can be prevented, so as to avoid a user from being interrupted with the noise.

Fourth, by holding up the shelf up to the end of fixing guides and sliding guides in order to detach the shelf, the shelf can be completely detached from the fixing guides and the sliding guides. In order to attach it again, the grabbing portions are pressed to rotate the operation levers, and thereafter the shelf is inserted into the upper end of the fixing guides and the sliding guides to be moved downwardly, so as to be mounted.

As such, the present invention can facilitate the attachment of the shelf to thusly improve operational effect, and also allow various special configurations in a refrigerating chamber by the facilitated attachment/detachment of the shelf.

BRIEF DESCRIPTION OF THE DRAWINGS

FIG. 1 is a front view showing an appearance of a refrigerator in accordance with a first embodiment of the present invention;

FIG. 2 is a front view partially showing an open state of a door for a refrigerator provided with a height adjusting apparatus of the shelf for the refrigerator in accordance with the first embodiment of the present invention;

FIG. 3 is an exploded perspective view showing a construction of the height adjusting apparatus of the shelf for the refrigerator in accordance with the first embodiment of the present invention;

FIG. 4 is a perspective view partially showing a structure of a fixing unit as one of main components of the height adjusting apparatus of the shelf for the refrigerator in accordance with the first embodiment of the present invention;

FIG. 5 is a perspective view showing that the shelf is upwardly moved in the height adjusting apparatus of the shelf for the refrigerator in accordance with the first embodiment of the present invention;

FIG. 6 is a schematic view showing an operation of the fixing unit in the state where the shelf is upwardly moved in the height adjusting apparatus of the shelf for the refrigerator in accordance with the first embodiment of the present invention;

FIG. 7 is a perspective view showing that the shelf is downwardly moved in the height adjusting apparatus of the shelf for the refrigerator in accordance with the first embodiment of the present invention;

FIG. 8 is a schematic view showing an operation of the fixing unit in the state where the shelf is downwardly moved in the height adjusting apparatus of the shelf for the refrigerator in accordance with the first embodiment of the present invention;

FIG. 9 is a schematic view showing a construction of a height adjusting apparatus of a shelf for a refrigerator in accordance with a second embodiment of the present invention;

FIG. 10 is a cross-sectional view taken along the line I-I of FIG. 9;

FIG. 11 is a front view partially showing an open state of a door for a refrigerator provided with a height adjusting apparatus of a shelf for the refrigerator in accordance with a third embodiment of the present invention;

FIG. 12 is a perspective view from a rear side of a drawer as one of main components of the height adjusting apparatus of the shelf for the refrigerator in accordance with the third embodiment of the present invention;

FIG. 13 is a perspective view from a bottom of the drawer having disposed as one of main components of the height adjusting apparatus of the shelf for the refrigerator in accordance with the third embodiment of the present invention;

FIG. 14 is an exploded perspective view showing a construction of a fixing unit as one of main components of the height adjusting apparatus of the shelf for the refrigerator in accordance with the third embodiment of the present invention;

FIG. 15 is a perspective view showing that the shelf is upwardly moved in the height adjusting apparatus of the shelf for the refrigerator in accordance with the third embodiment of the present invention;

FIG. 16 is a schematic view showing an operation of the fixing unit in the state where the shelf is upwardly moved in the height adjusting apparatus of the shelf for the refrigerator in accordance with the third embodiment of the present invention;

FIG. 17 is a perspective view showing that the shelf is downwardly moved in the height adjusting apparatus of the shelf for the refrigerator in accordance with the third embodiment of the present invention;

FIG. 18 is a schematic view showing an operation of the fixing unit in the state where the shelf is downwardly moved in the height adjusting apparatus of the shelf for the refrigerator in accordance with the third embodiment of the present invention;

FIG. 19 is a schematic view showing a construction of a height adjusting apparatus of a shelf for a refrigerator in accordance with a fourth embodiment of the present invention; and FIG. 20 is a cross-sectional view taken along the line II-II of FIG. 19.

MODES FOR CARRYING OUT THE PREFERRED EMBODIMENTS

Reference will now be made in detail to the height adjusting apparatus of the shelf for the refrigerator having such configuration in accordance with the preferred embodiments of the present invention, examples of which are illustrated in the accompanying drawings.

For the sake of description for the preferred embodiments of the present invention, a bottom freeze type refrigerator in which a freezing chamber is disposed below a refrigerating chamber will be exemplarily explained. However, the present invention may not be limited to the type of refrigerator but be applicable to any type of refrigerators.

FIG. 1 is a front view showing an appearance of a refrigerator in accordance with a first embodiment of the present invention, and FIG. 2 is a front view partially showing an open state of a door for the refrigerator having the height adjusting apparatus of the shelf in accordance with the first embodiment.

As shown in FIGS. 1 and 2, a main body 100 of the refrigerator may be formed in an approximately rectangular shape. A refrigerating chamber 120 and a freezing chamber 140 are provided in the main body 100 to store articles to be stored (e.g., food, containers containing food, other groceries, etc.) in a fresh state and a frozen state, respectively.

The refrigerating chamber 120 and the freezing chamber 140 may be divided by a barrier (not shown) to be formed at upper and lower portions of the refrigerator, respectively. Refrigerating chamber doors 122 are provided at the refrigerating chamber 120 to selectively open or close the refrigerating chamber 120, and a freezing chamber door 142 is provided at the freezing chamber 140 to selectively open or close the freezing chamber 140.

The refrigerating chamber doors 122 may be implemented as a side-by-side door type provided at right and left sides at a front surface of the refrigerating chamber 120 such that the two doors 122 can be opened or closed by being rotated respectively in left and right directions. The freezing door 142 may be configured to be open by being drawn out like a drawer after being tilted by a certain angle.

Also, a refreshment center (so-called "home-bar") or a dispenser may further be provided at the front surface of one of the refrigerating doors 122 for the user's convenience. Such configuration is the same as that of a typical refrigerator, detailed description of which will thusly be omitted.

Meanwhile, still referring to FIG. 2, the inner space of the refrigerating chamber 120 may be partitioned by a plurality of drawers 160 and shelves 200 provided therein, such that articles to be stored in a fresh state can be received in each divided compartment.

In more detail, each drawer 160 may be provided at a lower portion of the refrigerating chamber 120. The drawer 160 may be configured as one compartment or two compartments divided into left and right ones so as to store various sizes of food. Also, an amount of cold air supplied into the drawer 160 may be controlled such that an inner temperature of the drawer 160 can be adjusted appropriate for types of articles received therein.

A plurality of shelves 200 may be provided above the drawer 160. A plurality of the shelves 200 may partition the inner space of the refrigerating chamber 120 into upper and lower sections. The plurality of shelves 200 may be disposed at left and right sides in the refrigerating chamber 120, respectively.

As such, the plurality of shelves 200 may be configured such that each height thereof can selectively be adjusted by a user's simple manipulation, thereby allowing the inner space of the refrigerating chamber 120 to be utilized in various ways.

To this end, fixing guides 300 and sliding guides 520 (See FIG. 3) may be formed vertically long in the refrigerating chamber 120. Accordingly, the shelves 200 can be moved up and down along the fixing guides 300 and the sliding guides 520.

FIG. 3 is an exploded perspective view showing a construction of the height adjusting apparatus of the shelf for the refrigerator in accordance with the first embodiment of the present invention. Constructions of the shelf 200, the fixing guides 300 and the sliding guides 520 will be described in detail with reference to FIG. 3.

The shelf 200 may be composed of a shelf plate 220 and a shelf frame 240. The shelf plate 220 may form an upper surface of the shelf 200 such that articles (e.g., food, containers containing food, etc.) can be placed thereon upon accommodating the articles. The shelf plate 220 may be formed in an approximately square plate-like shape. Most areas of the shelf plate 220 may be formed of a transparent plastic or a tempered glass such that a user can easily check food below the shelf 200. Also, an outer circumference of the shelf plate 220 may be formed of a plastic or the like.

The shelf frame 240 may define a frame of the shelf 200. The shelf frame 240 may be coupled to the fixing guides 300 to be explained later in detail to support the shelf plate 220 at the bottom thereof.

That is, the shelf frame 240 may be composed of a front frame 242 forming a front side thereof, a rear frame 244 forming a rear side thereof and side frames 246 disposed at both left and right sides. Such front frame 242, the rear frame 244 and the side frames 246 are then coupled to be shaped like a square frame corresponding to the shape of the shelf plate 220. Accordingly, the shelf plate 220 can be disposed on the shelf frame 240.

The shelf frame 240 may be formed of steel or plastic. If the shelf frame 240 is formed of steel, the shelf frame 240 may be formed to be approximately L-shaped such that fixing units 400 and rolling units 500 to be explained later can easily be mounted.

The shelf plate 220 and the shelf frame 240 may be integrally formed with each other. In this case, preferably, both the shelf plate 220 and the shelf frame 240 are formed of a plastic.

Two fixing guides 300 are provided inside the refrigerating chamber 120. Each fixing guide 300 penetrates through one side of the shelf 200 to guide the shelf 200 upwardly or downwardly. Each fixing guide 300 may be formed of an approximately filled cylindrical bar. Brackets 320 may be installed at upper and lower ends of each fixing guide 300 such that the fixing guide 300 can be spaced apart from a rear wall surface of the refrigerating chamber 120.

The fixing guides 300 may be formed in parallel with a lifting path of the shelf 200.

The fixing guides 300 preferably penetrate through left and right sides at a rear end of the shelf 200, respectively. In more detail, the fixing guides 300 are installed by vertically penetrating through the rear frame 244, respectively.

Rolling units 500 may further be provided at one side of the rear frame 244 and an inside of the refrigerating chamber 120 corresponding to the one side of the rear frame 244. Each rolling unit 500 may include a sliding guide 520 and rolling rollers 540 to thusly allow the shelf 200 to be smoothly stably moved upon the vertical movement of the shelf 200.

Each sliding guide 520 may be formed vertically long, and contacted by the rolling rollers 540 to be explained herebelow, so as to guide the shelf 200 to be smoothly moved. The sliding guides 520 are attached respectively at both left and right sides at a rear wall surface of the refrigerating chamber 120. Here, the sliding guides 520 are preferably installed between the fixing guides 300.

That is, the sliding guides 520 may be formed at positions coming in contact with the corresponding rolling rollers 540. An outer side surface of each sliding guide 520 may have a section in a wedge shape like ">" to then protrude to the outside.

In the meantime, the rolling rollers 540 may be provided at a rear end portion of the shelf 200. Each rolling roller 540 is rolled by being in contact with the corresponding sliding guide 520. The rolling roller 540 is rolled up and down along the corresponding sliding guide 520, to complementarily allow a smooth movement of the shelf 200.

In more detail, the rolling rollers 540 are installed, respectively, at both left and right sides at the rear surface of the rear frame 244 of the shelf 200. Also, the rolling rollers 244 may be rotatably installed at each frame of the rear frame 244, which is implemented by two frames disposed up and down with each other. Accordingly, 4 rolling rollers 540 may totally be installed.

A roller recess 542 having a wedge shape (i.e., the shape like ">") corresponding to the shape of the outer side surface of the sliding guide 520 may be formed in an outer circumference of each rolling roller 540. The roller recess 542 may be in contact with the outer side surface of the sliding guide 520 such that the rolling roller 540 can be rotated therealong.

The rolling rollers 540 may be provided, as a pair, at both left and right sides of the rear frame 244, respectively, to be simultaneously in contact with the sliding guides 520. Accordingly, the shelf 200 may be stably moved without a distortion during the vertical movement thereof.

Fixing units 400 may be provided respectively at both sides of the rear portion of the shelf 200. The fixing units 400 serves to fix (lock) the shelf 200 after the shelf 200 is moved up or down to a desired height. As such, the fixing units 400 may be simply rotated by a certain angle to selectively release the locked state of the shelf 200 and thusly to facilitate the vertical movement of the shelf 200.

FIG. 4 is a perspective view partially showing a structure of a fixing unit as one of main components of the height adjusting apparatus of the shelf for the refrigerator in accordance with the first embodiment of the present invention. As shown in FIG. 4, describing the fixing unit 400 in more detail, each fixing unit 400 may include an operation lever 420 and an elastic member 440.

The operation lever 420 is rotated by a user's manipulation to be in contact with the corresponding fixing guide 300, thereby locking the shelf 200.

That is, the operation lever 420 may include an operation portion 422, grabbing portion 424 and a rotation restricting portion 426. The operation lever 420 may be implemented by curving a plate-like material. When viewing the operation lever 420 at a side thereof, the operation lever 420 may be formed to have one side opened. Here, a curved upper portion of the operation lever 420 may be longer than a curved lower portion thereof. A vertical length of the operation lever 420 except for the upper and lower portions may be longer than the lengths of the upper and lower portions.

The operation portion 422 may define the upper portion of the operation lever 420, and has a through hole 423 in which the fixing guide 300 is inserted. The through hole 423 may be greater in size than the fixing guide 300. As the operation lever 420 rotates, an inner circumferential surface of the through hole 423 may selectively be in contact with an outer circumferential surface of the fixing guide 300.

One end of the operation portion 422 may be hinge-coupled to one side of the shelf 200, in more detail, to one side of the rear frame 244. Therefore, the operation lever 420 may be rotatable based on one end of the operation portion 422 as a rotational shaft.

When the shelf 200 is moved upwardly or downwardly, the operation lever 420 may be rotated such that the fixing guide 300 can be in parallel with the penetrating direction of the through hole 423.

In detail, when the shelf 200 is moved upwardly, the operation lever 420 may be rotated by its weight. When the shelf 200 is moved downwardly, the operation lever 420 may be rotated by an external force, for example, applied by a user.

When the shelf 200 is completely lifted, the operation lever 420 may be rotated to be inclined with respect to the fixing guide 300, such that the fixing guide 300 can be in contact with the inner surface of the through hole 423.

A support member 430 having an approximately wedge shape may further be provided at a lower surface of the operation portion 422. The support member 430 may be in contact with an upper end of an elastic member 440 to be explained later. The support member 430 is configured to stably transfer an elastic force of the elastic member 440 to the operation portion 422. As shown in FIG. 4, the support member 430 may be installed such that an inclined portion of the support member 430 is in contact with a lower surface of the operation portion 422 and a horizontal portion thereof is in contact with an upper end of the elastic member 440.

Elasticity by a restoring force of the elastic member 440 always tries to rotate the operation portion 422 upwardly. One side of the through hole 423 formed in the operation portion 422 is in contact with the outer circumferential surface of the fixing guide 300 to fix the shelf 200.

The support member 430 may have a hollow central portion such that the fixing guide 300 can be inserted therethrough. In this case, the hollow central portion is preferably formed to be aligned with the through hole 423.

As the operation lever 420 is rotated, the fixing guide 300 comes in contact with an inner circumferential surface of the through hole 423 and also with a hollow inner circumferential surface of the support member 430, to thusly more improve a force to fix the shelf 200.

The support member 430 may not be separately disposed at the operation portion 422. Instead, when molding the operation portion 422, the operation portion 422 may be integrally molded with the support member 430 as if the support member 430 is installed thereat.

After the shelf 200 is completely lifted, when the operation lever 420 is rotated, the support member 430 may be interposed between the elastic member 440 and the operation lever 420 such that the operation lever 420 can substantially be perpendicular to a direction in which the elastic member 440 is tensioned.

The other end opposite to one end of the hinge-coupled operation lever 422 is perpendicularly curved to extend downwardly, thereby forming the grabbing portion 424.

A user may grab the grabbing portion 424 and press it to rotate the operation lever 420. Accordingly, the grabbing portion 424 may preferably extend to have a sufficient length such that the user can easily grab it.

The rotation restricting portion 426 may be formed to be perpendicularly curved from a lower end of the grabbing portion 424 in a direction in which the operation portion 422 is formed. When the operation lever 420 is rotated, the rotation restricting portion 426 is restricted by one side of the fixing guide 300 to thereby stop the rotation of the operation lever 420. The rotation restricting portion 426 may preferably extend to be shorter than the operation portion 422.

Therefore, when the operation lever 420 illustrated in FIG. 4 has excessively been rotated in a counterclockwise direction, an end of the rotation restricting portion 426 comes in contact with the outer surface of the fixing guide 300, so as to allow the operation lever 420 to be appropriately rotated upon manipulating the operation lever 420.

The elastic member 440 may be provided at one side of the operation lever 420. The elastic member 440 may forcibly rotate the operation lever 420. Preferably, the elastic member 440 is implemented as a compression spring.

The elastic member 440 may be interposed between one side of the shelf 200 and the operation lever 420 to support an elastic force to rotate the operation lever 420. That is, the elastic member 440 is interposed between the operation portion 422 and the rear frame 244 of the shelf 200 corresponding to the operation portion 422, and the fixing guide 300 is inserted therethrough. An upper surface of the elastic member 440 comes in contact with a lower surface of the support member 430, and a lower surface thereof comes in contact with an upper surface of the rear frame 244.

Therefore, the elastic member 440 supports an elastic force such that the operation lever 420 can always rotate in the counterclockwise direction. In the state where the operation lever 420 is forcibly rotated in a counterclockwise direction, the through hole 423 of the operation portion 422 is inclined. Accordingly, the inner circumferential surface of the through hole 423 comes in contact with the outer circumferential surface of the fixing guide 300, thereby maintaining the shelf 200 in the fixed state.

Hereinafter, an operation of the height adjusting apparatus of the shelf for the refrigerator in accordance with the first embodiment of the present invention will be described with reference to the following drawings.

FIG. 5 is a perspective view showing that the shelf is upwardly moved in the height adjusting apparatus of the shelf for the refrigerator in accordance with the first embodiment of the present invention, and FIG. 6 is a schematic view showing an operation of the fixing unit in the state where the shelf is upwardly moved in the height adjusting apparatus of the shelf for the refrigerator in accordance with the first embodiment of the present invention.

FIG. 7 is a perspective view showing that the shelf is downwardly moved in the height adjusting apparatus of the shelf for the refrigerator in accordance with the first embodiment of the present invention, and FIG. 8 is a schematic view showing the operation of the fixing unit in the state where the shelf is downwardly moved in the height adjusting apparatus of the shelf for the refrigerator in accordance with the first embodiment of the present invention.

As shown in FIGS. 5 to 8, the shelf 200 may be maintained in its disposed state until an external force is applied thereto. The pair of fixing units 400 makes it available. That is, the operation lever 420 of each fixing unit 400 is always maintained in the state rotated in the counterclockwise direction by an elastic restoring force of the elastic member 440 of each fixing unit 400. Accordingly, one side of the through hole 423 presses the outer circumferential surface of the fixing guide 300. As a result, the shelf 200 may be fixed without being slid downwardly due to its weight.

Such operation may be equally applied to the case where articles such as food are accommodated on the upper surface of the shelf 200. In this case, the shelf 200 is pressed downwardly by its own weight and the articles accommodated thereon. If the shelf 200 is allowed to be further moved downwardly, the through hole 423 of the operation levers 420 presses the outer circumferential surface of the fixing guide 300 more strongly, thereby fixing the shelf 200 without being slid.

Here, if the shelf 200 is moved upwardly in order to obtain a greater space below the shelf 200, the user grabs both sides of the shelf 200 or the shelf frame 240 holds up the shelf 200. Each fixing unit 400 then temporarily loses its constraining force. Accordingly, the user may move the shelf 200 upwardly.

That is, when moving the shelf 200 or the shelf frame 240, the operation lever 420 is temporarily rotated minutely in a clockwise direction to compress the elastic member 440 to some extent. As the operation lever 420 is rotated, the through hole 423 becomes apart from the outer circumferential surface of the fixing guide 300 having contacted by the through hole 423.

Accordingly, a force for pressing each fixing guide 300 to fix the shelf 200 is released such that the shelf 200 can freely be moved upwardly. If the shelf 200 is continuously moved upwardly, the shelf 200 is upwardly moved along the fixing guides 300.

After moving the shelf 200 up to a desired height, if an external force is not applied upwardly to the shelf 200 any more by leaving the shelf 200 grabbed by hands, the operation lever 420 is then rotated again in the counterclockwise direction by the restoring force of the elastic member 440 and accordingly, the through hole 423 thereof presses the outer circumferential surface of the fixing guide 300.

In addition, as the weight of the shelf 200 and weights of the articles stored on the shelf 200 are applied, the operation lever 420 more strongly presses the fixing guide 300, thereby stably fixing the position of the shelf 200.

Then, in order to increase a space above the shelf 200, the shelf 200 should be lowered. To this end, the user may manipulate the fixing units 400 to move the shelf 200 downwardly.

That is, in order to move the shelf 200 downwardly, the user presses the grabbing portion 424 or one side of the operation portion 422 to rotate the operation lever 420 of each fixing unit 400 in a clockwise direction.

When the grabbing portion 424 is pressed to rotate the operation lever 420 in the clockwise direction, the through hole 423 and the fixing guide 300 having contacted by each other become apart from each other. Accordingly, a constraining force having applied to the fixing guide 300 is released such that the shelf 200 can be moved downwardly.

Afterwards, when the shelf 200 is moved downwardly as the user presses the grabbing portion 424 and thereby the operation lever 420 is rotated, the shelf 200 is downwardly moved along the fixing guide 300.

Here, the rotation restraining portion 426 of the operation lever 420 may restrain the grabbing portion 424 from being rotated over a certain angle. Accordingly, it is possible to prevent the through hole 423 from being in contact with the fixing guide 300 due to an excessive rotation of the operation lever 420.

That is, the user presses the grabbing portion 424 as strong as the rotation restraining portion 426 is not in contact with the fixing guide 300 so as to adjust the rotation angle of the operation lever 420. By adjusting the rotation angle of the operation lever 420, the through hole 423 is maintained without being in contact with the fixing guide 300, thus to facilitate the movement of the shelf 200.

In the state of the grabbing portion 424 being pressed, the elastic member 440 is in a compressed state. After moving the shelf 200 down to a desired position, if an external force is not applied any more to the grabbing portion 424 by taking hands off, which have pressed each grabbing portion 424, the operation lever 420 is then rotated in the counterclockwise direction by the restoring force of the elastic member 440.

As the operation lever 420 is rotated in the counterclockwise direction, the through hole 423 of the operation lever 420 presses again the outer circumferential surface of the fixing guide 300 so as to fix the position of the shelf 200.

Upon the upward or downward movement of the shelf 200, the rolling rollers 540 mounted at the rear frame 244 are rolled along the sliding guide 520. The rolling motion of the rolling rollers 540 can allow the shelf 200 to be smoothly moved upwardly or downwardly.

In particular, as a protrusion of each sliding guide 520 performs a relative motion in the state of being received in the corresponding roller recesses 542 of the rolling rollers 540, the shelf 200 can be moved more stably. A pair of the rolling rollers 540 is provided at each of the left and right sides of the shelf 200. Accordingly, the shelf 200 can be moved upwardly or downwardly without any distortion or inclination.

Hereinafter, another embodiment of the present invention will be described with reference to the drawings. To explain the another embodiment, duplicative description with the description of the first embodiment will not be repeated.

FIG. 9 is a schematic view showing a construction of a height adjusting apparatus of a shelf for a refrigerator in accordance with a second embodiment of the present invention, and FIG. 10 is a cross-sectional view taken along the line I-I of FIG. 9.

As shown in FIGS. 9 and 10, each rolling unit 500 may include a receiving guide 560, a protruding portion 580 and rolling members 582.

The receiving guide 560 may be installed at one side in the refrigerating chamber 120, in more detail, at each of left and right sides of a rear wall surface in the refrigerating chamber 120 to guide the protruding portion 580, which will be described later, to be moved upwardly or downwardly. Each receiving guide 560 may be formed vertically long. The receiving guides 560 may be installed at the rear wall surface of the refrigerating chamber 120 corresponding to both side ends of the shelf 200.

Each receiving guide 560 may be formed to receivable a protruding portion 580 to be explained below, and have a section with one side opened. The protruding portion 580 may be protruded from the opened one side of the receiving guide 560 such that the protruding portion 580 inserted therein cannot be easily released therefrom.

The protruding portion 580 may be formed to have a section with a protruded shape. That is, the protruding portion 580 may backwardly extend from left and right sides of a rear surface of the rear frame 244 in a perpendicular direction, so as to be inserted into the corresponding receiving guide 560.

A plurality of rolling members 582 may be installed at a left side end of the protruding portion 580. The rolling members 582 may be rolled by being in contact with an inner wall surface of the receiving guide 560 when the protruding portion 580 is accommodated in the corresponding receiving guide 560, so as to allow the protruding portion 580 to be smoothly moved upwardly or downwardly. The rolling members 582 may preferably be implemented as ball bearings or roller bearings.

In this embodiment of the height adjusting apparatus of the shelf for the refrigerator according to the present invention, the operation of adjusting the height of the shelf 200 is the same as that in the first embodiment except for the operation of a rolling unit 500. That is, in this embodiment, the protruding portions 580 at both sides of the shelf frame 240 are moved with being accommodated in the receiving guides 560, such that the shelf 200 can be stably moved upwardly or downwardly without detachment or self-motion.

FIG. 11 is a front view partially showing an open state of a door for a refrigerator provided with a height adjusting apparatus of a shelf for the refrigerator in accordance with a third embodiment of the present invention, FIG. 12 is a perspective view from a rear side of a drawer as one of main components of the height adjusting apparatus of the shelf for the refrigerator in accordance with the third embodiment of the present invention, and FIG. 13 is a perspective view from a bottom of the drawer having disposed as one of main components of the height adjusting apparatus of the shelf for the refrigerator in accordance with the third embodiment of the present invention As shown in FIGS. 11 to 13, the shelf frame 240 may be coupled to fixing guides 600 by fixing units 700 to be explained in detail herebelow, to support the shelf plate 220 from a lower side of the shelf plate 220.

Two fixing guides 600 may be provided inside the refrigerating chamber 120. The fixing guides 600 may selectively be coupled to the fixing units 700 to determine the height of the shelf 200. The fixing guides 600 may be installed long in a vertical direction on a rear wall surface in the refrigerating chamber 120 close to both sides of the rear end portion of the shelf 200.

Each fixing guide 600 may be formed to protrude to some degree from the rear wall surface inside the refrigerating chamber 120, and have an approximately square or rectangular section. A fixing hole 620 is formed in the protruded front surface of each fixing guide 600.

The fixing hole 620 is provided to be coupled to one side of the corresponding fixing unit 700 to be explained hereafter, and is punched in the front surface of each fixing guide 600. The fixing hole 620 may have a shape corresponding to that of one side of the fixing unit 700 such that the one side of the fixing unit 700 can be inserted therein. The fixing hole 620 may be provided in plurality in the front surface of the fixing guide 600 at a constant interval such that the shelf 200 can be fixed at different positions.

Although not shown, in case where the fixing guide 600 is not formed to have a shape of a square pillar having an inside which is not hollow, recesses or dentate members may be formed into the front surface of the fixing guide 600. The fixing hole 620 may be varied to have various structures capable of selectively restricting part of the fixing unit 700 to be explained hereafter.

The fixing units 700 may be provided at both left and right sides of a rear surface of the shelf 200, respectively. The fixing units 700 are adapted to fix the shelf 200 after being moved up or down to a desired height. The fixing unit 700 may be configured to selectively release a locked state of the shelf 200 only by a simple manipulation, such as rotating by a certain angle, and also to facilitate the vertical movement of the shelf 200.

FIG. 14 is an exploded perspective view showing a construction of a fixing unit as one of main components of the height adjusting apparatus of the shelf for the refrigerator in accordance with the third embodiment of the present invention. As shown in FIG. 14, each fixing unit 700 may include an operation lever 720 and an elastic member 740.

The operation lever 720 may be rotated by the user's manipulation to be in contact with the corresponding fixing guide 600, so as to fix the shelf 200.

In more detail, the operation lever 720 may include a grabbing portion 726, a fixing portion 724 and rotating portions 722. The operation lever 720 may be implemented by curving a plate-like material having a relatively narrow width.

The grabbing portion 726 is provided to allow a user to grab it when the user desires to rotate the operation lever 720. The grabbing portion 726 may be formed long toward the front end of the shelf 200 and extend to make the user easily hold it.

The fixing portion 724 may be extendingly formed by being curved downwardly from a front end of the grabbing portion 726 by an approximately 45°. The fixing portion 724 may be coupled to one side of the fixing hole 620 of the fixing guide 600 to lock the shelf 200. The fixing portion 724 may extend to have a sufficient length such that a front end thereof can be inserted into the fixing hole 620 in a state where the grabbing portion 726 is in parallel with the shelf 200.

That is, an insertion end 723 may be formed at the front end of the fixing portion 724. When fixing the shelf 200 by using the operation lever 720, the insertion end 723 may be inserted into the fixing hole 620. The insertion end 723 may protrude forwardly from the front end of the fixing portion 724, and also have a width such that it can be inserted into the opened fixing hole 620.

Support ends 725 may be formed at both side ends of the fixing portion 724. The support ends 725 may be perpendicularly curved from both ends of left and right sides of the fixing portion 724 in a lower direction. Accordingly, the support ends 725 may allow the insertion end 723 to be maintained in the inserted state in the fixing hole 620 such that the shelf 200 can continuously be fixed.

A front end of each support end 725 may be located at a rear side rather than the front end of the insertion end 723. Accordingly, when the insertion end 723 is inserted into any of the fixing hole 620, the front ends of the support ends 725 may be in contact with the front surface of the fixing guide 600 to thusly maintain the insertion end 723 in the inserted state into the fixing hole 620.

The rotating portions 722 may be formed at a front part of the grabbing portion 726, namely, a location adjacent to the fixing portion 724. The rotating portions 722 may be axially coupled to the one side of the shelf 200 such that the operation lever 720 can be rotated. The rotating portions 722 may be perpendicularly curved from both ends of left and right sides of the grabbing portion 726 in an upper direction.

The curved rotating portions 722 may be mounted so as to be engaged between coupling portions which protrude downwardly from the lower surface of the rear frame 244, to thereby be pin-coupled therebetween by a rotational shaft 727 which penetrates through both the rotating portions 722 and the coupling portions. Accordingly, the operation lever 720 may be rotatable centering around the rotational shaft 727, and the fixing portion 724 may be rotatable by manipulating the grabbing portion 726.

Stop pins may be mounted at both end portions of the rotational shaft 727 coupling the rotating portions 722 and the coupling portions so as to penetrate through the rotational shaft 727, thereby preventing the rotational shaft 727 from being unexpectedly separated.

Such configured operation lever 720 may be connected to the fixing hole 620 so as to support the load of the shelf 200.

When the shelf 200 is moved upwardly, the operation lever 720 may be rotated such that the operation lever 720 can be disconnected from the fixing hole 620. Also, when the shelf 200 is completely moved upwardly, the operation lever 720 may be reconnected to the fixing hole 620 so as to support the load of the shelf 200.

When the shelf 200 is moved downwardly, the connection between the operation lever 720 and the fixing hole 620 may be released by an external force.

In the meantime, the elastic member 740 may be installed at the rotational shaft 727. The elastic member 740 may forcibly rotate the operation lever 720 in one direction. The fixing portion 724 of the operation lever 720 may be inserted into the fixing hole 620 of the fixing guide 600 by the elastic force of the elastic member 740 to be maintained in the coupled state therebetween.

The elastic member 740 may preferably be implemented as a torsion spring multiply wound. In order to apply the elastic force to the operation lever 720 in one direction, one end of the elastic member 740 may be fixed by being in contact with the upper surface of the rear frame 244, and the other end thereof may be inserted into an insertion hole 721 formed through a front end of the grabbing portion 726 so as to apply a restoring force to the operation lever 720 when the operation lever 720 is rotated.

The operation of such configured height adjusting apparatus of the shelf for the refrigerator in accordance with the third embodiment of the third embodiment of the present invention will now be described with reference to the drawings.

FIG. 15 is a perspective view showing that a shelf is upwardly moved in the height adjusting apparatus of the shelf for the refrigerator in accordance with the first embodiment of the present invention, and FIG. 16 is a schematic view showing an operation of the fixing unit in the state where the shelf is upwardly moved in the height adjusting apparatus of the shelf for the refrigerator in accordance with the third embodiment of the present invention.

FIG. 17 is a perspective view showing that a shelf is downwardly moved in the height adjusting apparatus of the shelf for the refrigerator in accordance with the third embodiment of the present invention, and FIG. 18 is a schematic view showing an operation of the fixing unit in the state where the shelf is downwardly moved in the height adjusting apparatus of the shelf for the refrigerator in accordance with the third embodiment of the present invention.

As shown in the drawings, the shelf 200 may continuously be fixed until an external force is applied thereto. This is available by the pair of fixing units 700. The operation lever 720 of each fixing unit 700 may always be maintained in the rotated state in the clockwise direction by the elastic force of the elastic member 740 of each fixing unit 700 and accordingly, the front end of the fixing portion 724, i.e., the insertion end 723 may be inserted into the fixing hole 620 of the fixing guide 600.

In the state of the insertion end 723 inserted into the fixing hole 620, even if the weight of the shelf 200 or weights of articles stored on the shelf 200 are applied downwardly, the fixing portion 724 may functions as a lever so as to fix the shelf 200 not to be lowered anymore.

As shown in FIGS. 15 and 16, in order to ensure more space below the shelf 200 by upwardly moving such conditioned shelf 200, if the user may grasp the shelf 200 or both sides of the shelf frame 240 to lift the shelf 200, a force which the fixing units 700 fix the shelf 200 may be released temporarily so that the shelf 200 can be moved upwardly.

That is, when the shelf 200 or the shelf frame 240 is held up, the insertion end 723 may temporarily be pushed out by the fixing guide 600. Accordingly, the operation lever 720 is minutely rotated in a counterclockwise direction to thereby compress the elastic member 740.

In this state, the insertion end 723 is completely released from the inserted fixing hole 620. Accordingly, a force to fix the shelf 200 is not applied thereto any more, and thusly the shelf 200 may freely be moved upwardly.

When the shelf 200 is continuously held up to be moved upwardly, the insertion end 723 may pass through the plurality of fixing holes 620 to be moved upwardly. Here, the insertion end 723 may continuously make noise by being bumped against the fixing holes 620 by the restoring force of the elastic member 740.

After moving the shelf 200 up to a desired height, if the hands holding the shelf 200 are taken away to remove the external force applied to the shelf 200, the operation lever 720 may be rotated again in the clockwise direction by the restoring force of the elastic member 740, such that the insertion end 723 of the fixing portion 724 can be inserted into the fixing hole 620 of the fixing guide 600.

Also, if the weight of the shelf 200 and the weights of articles placed on the shelf 200 are applied to press the shelf 200 downwardly, the insertion end 723 inserted into the fixing hole 620 of the fixing guide 600 functions a the lever. Accordingly, the shelf 200 may be fixed so as not to be moved downwardly any more, thereby maintaining the mounted location of the shelf 200.

In order to increase the space above the shelf 200, the height of the shelf 200 should lowered. To this end, the user manipulates the pair of fixing units 700 to move the shelf 200 downwardly.

That is, as shown in FIGS. 17 and 18, to move the shelf 200 downwardly, the user simultaneously holds the grabbing portion 726 and the shelf 200 and then raises the grabbing portion 726 so as to rotate the operation lever 720 in a counterclockwise direction.

When the user raises the grabbing portion 726 to rotate the operation lever 720 in the counterclockwise direction, the fixing portion 724 also rotates in the counterclockwise direction. As a result, the insertion end 723 of the fixing portion 724 may be released from the fixing hole 620.

When the insertion end 723 is released from the fixing hole 620, the shelf 200 may freely be movable. If the hands holding the shelf 200 are smoothly down, the shelf 200 may smoothly be moved downwardly by its own weight and the weights of the articles on the shelf 200.

Here, the elastic member 740 may be compressed by the rotation of the operation lever 720, and continuously apply the restoring force to the operation lever 720. After moving the shelf 200 down to a desired location, if the hand pressing the grabbing portion 726 is taken away to remove the external force applied to the operation leer 720, the operation lever 720 may re-rotated in the clockwise direction by the restoring force of the elastic member 740.

When the operation lever 720 is rotated in the clockwise direction, the insertion end 723 of the operation lever 720 is inserted into a near fixing hole 620 of the fixing guide 600, such that the fixing portion 724 can be in the coupled sate to the fixing guide 600.

In this state, if the hands holding the shelf 200 are taken away, the shelf 200 may be lowered by its own weight and the weights of the articles on the shelf 200. Here, the fixing portion 724 may function as a lever to support the shelf 200 not to be moved downwardly, thereby fixing the moved location of the shelf 200.

FIG. 19 is a schematic view showing a construction of a height adjusting apparatus of a shelf for a refrigerator in accordance with a fourth embodiment of the present invention, and FIG. 20 is a cross-sectional view taken along the line II-II of FIG. 19.

As shown in FIGS. 19 and 20, the rolling unit 500 may include a receiving guide 560, a protruding portion 580 and rolling members 582.

The receiving guides 560 may be mounted at one side in the refrigerating chamber 120, particularly, at left and right sides of the rear wall surface of the refrigerating chamber 120, to guide the protruding portions 580 to be explained herebelow to be moved vertically. Each receiving guide 560 may be formed to be vertically long. The receiving guides 560 may be mounted at locations on the rear wall surface of the refrigerating chamber 120 corresponding to both side ends of the shelf 200.

The receiving guide 560 may be formed such that the corresponding protruding portion 580 can be inserted therein. The receiving guide 560 may have one side open, and the protruding portion 580 is formed in the open side such that the inserted protruding portion 580 may not easily be separated from the receiving guide 560.

Meanwhile, the protruding portions 580 may backwardly extend perpendicularly from both left and right sides of the rear surface of the rear frame 244. Also, the protruding portion 580 may have a protruded shape so as to be inserted into the receiving guide 560.

A plurality of rolling members 582 may be disposed at a left side end of the protruding portion 580. The rolling members 580 may be rolled by being in contact with the inner wall surface of the receiving guide 560, so as to allow a smooth vertical movement of the protruding portion 580. Preferably, the rolling members 582 may be implemented as ball bearings or roller bearings.

In the height adjusting apparatus of the shelf for the refrigerator according to the present invention, the operation of adjusting the height of the shelf 200 is the same as that in the aforementioned embodiment. However, in the operation of the rolling unit 500, as the protruding portion 580 at both sides of the shelf frame 240 are moved with being inserted in the receiving guides 560, the shelf 200 can stably be moved upwardly or downwardly without detachment or self-motion.

It will also be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

For example, the preferred embodiments of the present invention illustrates that the shelf 200 is movable upwardly or downwardly, but such configuration can be applied to a basket or drawer other than the shelf 200.

INDUSTRIAL AVAILABILITY

Regarding a height adjusting apparatus of a shelf for a refrigerator in accordance with one aspect of the present invention, the height of the shelf for the refrigerator can easily be adjusted, to increase its industrial availability.

The invention claimed is:

1. A height adjusting apparatus of a shelf for a refrigerator, in a refrigerator having the shelf on which objects to be stored are placed and which is movable up or down to a certain height, the apparatus comprising:

fixing guides formed in parallel with a movement path of the shelf and spaced along a rear edge of the shelf;

rolling units at one side of the shelf and configured to allow the shelf to be smoothly moved upwardly or downwardly without being tilted or distorted, the rolling units comprising first and second pairs of rolling members, each rolling member is installed at the rear surface of the shelf such that an axis of each rolling member being perpendicular to the rear edge of the shelf; and operation levers configured to be movable along the fixing guides when the shelf is moved upwardly or downwardly, and to be restricted on the fixing guides to maintain the moved height or location of the shelf when the shelf is completely moved upwardly or downwardly, wherein each of the operation levers is hinge-coupled to one side of the shelf, wherein each of the rolling units comprises a sliding guide formed in parallel with the movement path of the shelf, wherein each of the first and second pairs of rolling members is disposed at one side of the corresponding sliding guide in a vertical direction so as to simultaneously rollably contact the sliding guide, wherein each sliding guide has a cross section in a wedge shape to protrude outwardly, and wherein the rolling members are disposed at both rear end portions of the shelf in a vertical direction, and each has a roller recess formed in an outer circumference and having a wedge shape corresponding to the cross section of the sliding guide.

2. The apparatus of claim 1, wherein each of the operation levers includes a through hole in which the fixing guide is inserted to be moved therein when the shelf is moved upwardly or downwardly, and is rotated such that the fixing guide is in contact with an inner surface of the through hole so as to maintain the shelf at the height moved when the shelf is completely moved upwardly or downwardly.

3. The apparatus of claim 1, wherein a fixing hole is formed in the fixing guide, and wherein the operation lever is movable along the fixing guide when the shelf is moved upwardly or downwardly, and is rotated such that one end of the operation lever is connected to the fixed hole to maintain the shelf at the height moved when the shelf is completely moved upwardly or downwardly.

4. The apparatus of claim 1, wherein elastic members each of which supports an elastic force to each operation lever are provided.

5. The apparatus of claim 1, wherein the plural fixing guides are disposed respectively at both sides of the shelf.

6. A height adjusting apparatus of a shelf for a refrigerator in a refrigerator having the shelf on which objects to be stored are placed and which is movable up or down to a certain height, the apparatus comprising:

operation levers rotatably connected to a rear edge of the shelf;

rolling units at one side of the shelf and configured to allow the shelf to be smoothly moved upwardly or downwardly without being tilted or distorted; and fixing guides restricting the operation levers according to the rotation of the operation levers to maintain the shelf at a height that the shelf is moved upwardly or downwardly, wherein each of the rolling units comprises:

a sliding guide formed in parallel with the movement path of the shelf; and rolling rollers rotatably coupled to the shelf and rolled along the sliding guide when the shelf is moved upwardly or downwardly, including first and second pairs of rolling members, each rolling member is installed at the rear surface of the shelf such that an axis of each rolling member being perpendicular to the rear edge of the shelf, wherein each of the first and second pairs of rolling members is disposed at one side of the corresponding sliding guide in a vertical direction so as to simultaneously rollably contact the sliding guide, wherein each sliding guide has a cross section in a wedge shape to protrude outwardly, and wherein the rolling rollers are disposed at both rear end portions of the shelf in a vertical direction, and each has a roller recess formed in an outer circumference and having a wedge shape corresponding to the cross section of the sliding guide.

* * * * *